US011873819B2

(12) United States Patent
Pae et al.

(10) Patent No.: US 11,873,819 B2
(45) Date of Patent: Jan. 16, 2024

(54) IMPELLER FOR ELECTRIC WATER PUMP

(71) Applicant: COAVIS, Daejeon (KR)

(72) Inventors: Wan Sung Pae, Sejong-si (KR); Byeung Jin Kim, Daejeon (KR); Joon Seup Kim, Daejeon (KR)

(73) Assignee: COAVIS, Sejong-si (KR)

( * ) Notice: Subject to any disclaimer, the term of this patent is extended or adjusted under 35 U.S.C. 154(b) by 138 days.

(21) Appl. No.: 16/653,302

(22) Filed: Oct. 15, 2019

(65) Prior Publication Data

US 2020/0116151 A1 Apr. 16, 2020

(30) Foreign Application Priority Data

Oct. 15, 2018 (KR) ..... 10-2018-0122349

(51) Int. Cl.
*F04D 1/00* (2006.01)
*F04D 13/06* (2006.01)

(52) U.S. Cl.
CPC ..... *F04D 1/00* (2013.01); *F04D 13/06* (2013.01)

(58) Field of Classification Search
CPC ..... F04D 1/00; F04D 13/06; F04D 29/2255; F04D 29/2277; F04D 1/14; F04D 29/2222; F04D 29/669; F04D 13/08; F05D 2250/52; F01P 5/10
See application file for complete search history.

(56) References Cited

U.S. PATENT DOCUMENTS 4,720,242 A * 1/1988 Lovisetto ..... F04D 29/2222 416/186 A
4,752,187 A * 6/1988 Hergt ..... F04D 29/2205 416/186 R
4,986,736 A * 1/1991 Kajiwara ..... F04D 29/2227 416/181

(Continued)

FOREIGN PATENT DOCUMENTS

JP 05340388 A 12/1993
JP 2001082384 A 3/2001

(Continued)

OTHER PUBLICATIONS

Korean Office Action (Application No. 10-2018-0122349) dated Oct. 31, 2019.

*Primary Examiner* — Charles G Freay
*Assistant Examiner* — Lilya Pekarskaya
(74) *Attorney, Agent, or Firm* — NIXON PEABODY LLP

(57) ABSTRACT

The present invention relates to an impeller for an electric water pump capable of preventing a cavitation from occurring in the impeller according to the related art and improving a flow restriction in the impeller by changing an internal structure of the impeller in consideration of a flow of a coolant introduced into the impeller. The impeller for an electric water pump, includes: an inlet member formed in a pipe shape extending to allow a fluid to be introduced; an upper member connected to one end of the inlet member, extending to one side, and having an inner diameter increasing toward the one side; an extension member outwardly extending from one end of the upper member; and a lower impeller member coupled to an upper impeller member formed by the inlet member, the upper member, and the extension member to form a discharge space from which the fluid is discharged.

4 Claims, 4 Drawing Sheets

(56) References Cited

U.S. PATENT DOCUMENTS

| | | | | |
|---|---|---|---|---|
| 2006/0057005 | A1* | 3/2006 | Williams | F04D 29/426<br>417/423.14 |
| 2014/0341764 | A1* | 11/2014 | Muller | F04D 1/00<br>417/423.12 |
| 2016/0177962 | A1* | 6/2016 | Laing | F04D 29/0473<br>417/423.13 |
| 2017/0370373 | A1* | 12/2017 | Rausch | F04D 29/026 |
| 2018/0135500 | A1* | 5/2018 | Won | F04D 29/2266 |
| 2018/0216624 | A1* | 8/2018 | Turner | F04D 29/0473 |

FOREIGN PATENT DOCUMENTS

| | | | |
|---|---|---|---|
| JP | 2016098756 | A | 5/2016 |
| KR | 101332853 | B1 | 11/2013 |
| KR | 20180053469 | A | 5/2018 |

* cited by examiner

-Prior Art-

IMPELLER FOR ELECTRIC WATER PUMP

CROSS-REFERENCE TO RELATED APPLICATIONS

This application claims priority under 35 U.S.C. § 119 to Korean Patent Application No. 10-2018-0122349, filed on Oct. 15, 2018, in the Korean Intellectual Property Office, the disclosure of which is incorporated herein by reference in its entirety.

TECHNICAL FIELD

The following disclosure relates to an impeller for an electric water pump, and more particularly, to an impeller for an electric water pump capable of improving pumping efficiency and preventing blades in the impeller from being damaged by changing a structure of the impeller in consideration of a flow of a fluid introduced and discharged into and from the impeller for an electric water pump.

BACKGROUND

An electric water pump (EWP) is a pump driven by a motor controlled by a separate device and is mainly used for circulating a coolant. The electric water pump may determine a flow rate of the coolant regardless of a rotation speed of an engine, may decrease required power by 60 to 70% as compared with a mechanical water pump, and has a simple structure because it is driven by a motor instead of a belt. Therefore, the electric water pump has been widely used in a vehicle. In general, a fluid such as a coolant is discharged through an impeller rotating by a motor.

FIG. 1 illustrates an electric water pump according to the related art.

A configuration of the electric water pump according to the related art is simply described with reference to FIG. 1. The electric water pump according to the related art may include a pump housing including a lower pump housing 11 and an upper pump housing 12, a support shaft 20 installed in the pump housing, and an impeller 30 rotatably formed on the support shaft 20, and a fixing bolt 40 is coupled to the support shaft 20 to prevent the impeller 30 from being deviated while rotating.

As illustrated in FIG. 1, an inlet 13 is formed above the upper pump housing 12 to allow a fluid which is a discharge object (in general, a coolant, hereinafter, referred to as a "coolant") to be introduced into a flow space 31 in the water pump, and the introduced coolant is discharged outwards by a centrifugal force generated by the rotation of the impeller 30 and blades (although not illustrated in FIG. 1) formed in the impeller 30 in a height direction.

In the electric water pump according to the related art illustrated in FIG. 1, an upper member forming the flow space 31 is obliquely formed in a first region S1 of the impeller 30, such that the flow space 31 becomes narrower toward an edge portion of the impeller 30. Such a shape causes a cavitation (a phenomenon in which a rear region of the blades is in a vacuum state) of the coolant, which may cause damage of the blades.

In addition, the upper member obliquely formed and an inlet member formed in a vertical direction are connected to each other with an angle in a second region S2 of the impeller 30, and an angle is formed at a portion of the flow space 31 at which the upper member and the inlet member are connected to each other. In such a structure, turbulence of the fluid occurs at the corresponding portion and a flow restriction is thus increased. Therefore, pumping efficiency of the impeller is reduced.

In addition, the flow restriction of the fluid may occur not only in the second region S2 but also an interface portion of the support shaft 20 and the impeller 30 in a case where the support shaft 20 extends towards an inner upper side of the impeller 30.

RELATED ART DOCUMENT

Patent Document

Korean Patent Publication No. 10-1332853 ("Electronic water pump with cooling unit for vehicles", published on Nov. 27, 2013)

SUMMARY

An embodiment of the present invention is directed to providing an impeller for an electric water pump capable of preventing a cavitation from occurring in the impeller according to the related art and improving a flow restriction in the impeller by changing an internal structure of the impeller in consideration of a flow of a fluid introduced into the impeller.

In one general aspect, an impeller for an electric water pump, includes: an inlet member formed in a pipe shape extending to one side to allow a fluid to be introduced; an upper member connected to one end of the inlet member, extending to one side, and having an inner diameter increasing toward the one side; an extension member outwardly extending from one end of the upper member; and a lower impeller member coupled to an upper impeller member formed by the inlet member, the upper member, and the extension member to form a discharge space from which the fluid is discharged.

A length of the extension member may be 40 to 70% of a height of the discharge space in which the extension member is positioned.

A portion at which the upper member and the extension member are connected to each other may be a curved surface.

An edge portion of the lower impeller member and the extension member may be parallel with each other.

In another aspect, an impeller for an electric water pump, includes: an inlet member formed in a pipe shape extending to one side to allow a fluid to be introduced; an upper member connected to one end of the inlet member, extending to one side, and having an inner diameter increasing toward the one side; and a lower impeller member coupled to an upper impeller member formed by the inlet member and the upper member to form a discharge space from which the fluid is discharged, wherein a portion at which the inlet member and the upper member are connected to each other is formed in a curved surface.

In still another aspect, an impeller for an electric water pump, includes: an inlet member formed in a pipe shape extending to one side to allow a fluid to be introduced; an upper member connected to one end of the inlet member, extending to one side, and having an inner diameter increasing toward the one side; and a lower impeller member coupled to an upper impeller member formed by the inlet member and the upper member to form a discharge space from which the fluid is discharged, wherein lower impeller member having a support shaft inserted into a central portion thereof, and having a protruding portion protruding to one side and partially surrounding the support shaft, wherein an outer surface of the protruding portion includes a curved surface.

The impeller for an electric water pump may further include an extension member outwardly extending from one end of the upper member.

Inner surfaces of the upper impeller member and the lower impeller member that face each other may be parallel with each other to constantly maintain a width of the discharge space.

| [Detailed Description of Main Elements] | |
|---|---|
| 11: Lower pump housing | 12: Upper pump housing |
| 13: Inlet | 14: Discharge path |
| 15: Discharge space | |
| 20, 300: Support shaft | |
| 30: Impeller | 31: Flow space |
| 40: Fixing bolt | |
| 100: Upper impeller member | 110: Inlet member |
| 120: Upper member | 130: Extension member |
| 140: Support member | |
| 200: Lower impeller member | |
| 210: Protruding portion | |
| 310: Bearing | 320: Ball |

DETAILED DESCRIPTION OF EMBODIMENTS

Hereinafter, a preferred exemplary embodiment of an impeller for an electric water pump according to the present invention will be described in detail with reference to the accompanying drawings.

Figure 1:
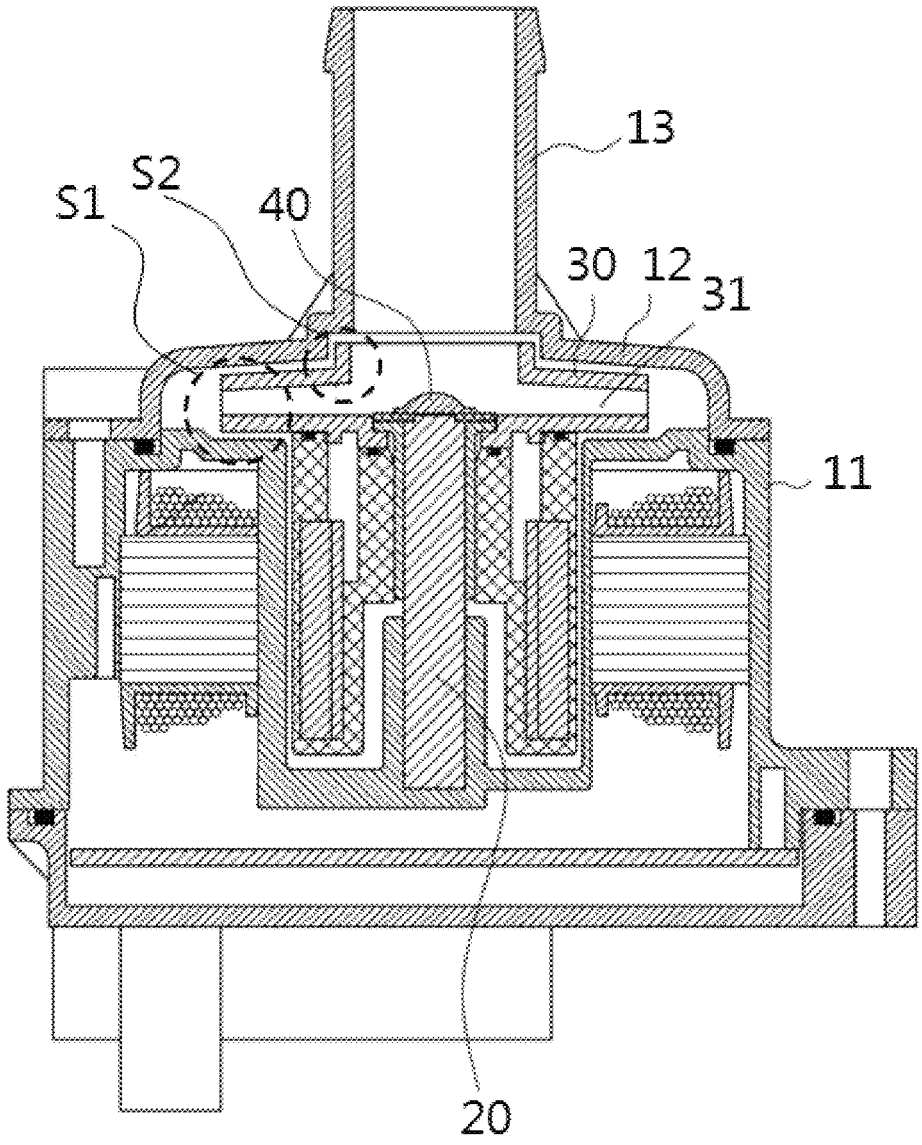
FIG. 1 is a cross-sectional view of an electric water pump according to the related art.
Figure 2:
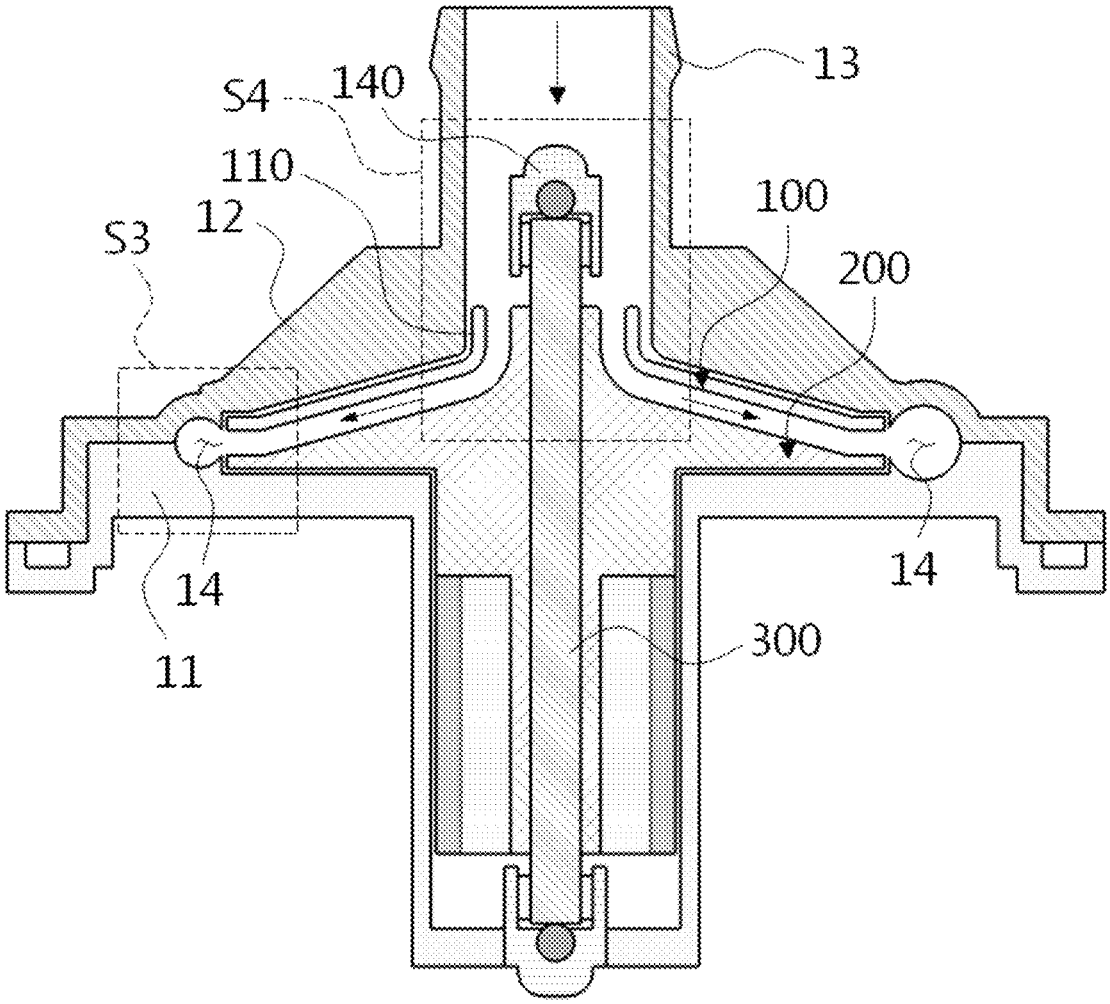
FIG. 2 is a cross-sectional view of an impeller for an electric water pump according to an exemplary embodiment of the present invention.

FIG. 2 illustrates a cross-sectional view of an impeller for an electric water pump according to an exemplary embodiment of the present invention.

As illustrated in FIG. 2, the impeller for an electric water pump according to an exemplary embodiment of the present invention may include an upper impeller member 100 and a lower impeller member 200 which are installed inside a lower pump housing 11 and an upper pump housing 12 to be assembled with each other in an assembling manner and rotate. An inlet 13 is formed on one side of the upper pump housing 12 and a fluid may be introduced into the impeller through the inlet 13.

As illustrated in FIG. 2, the upper impeller member 100 constitutes an upper portion of the impeller.

Figure 3:
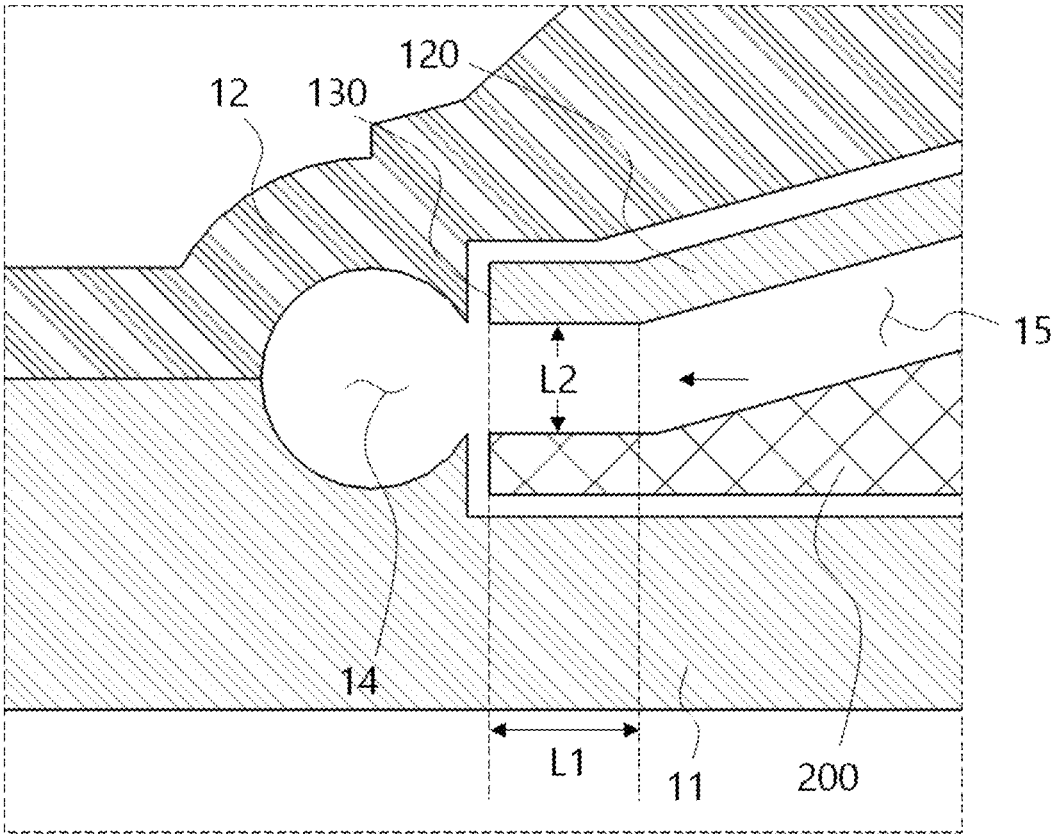
FIG. 3 is a partially enlarged view of FIG. 2.

FIG. 3 illustrates an enlarged view of a third region S3 illustrated in FIG. 2.

As illustrated in FIGS. 2 and 3, the upper impeller member 100 may include an inlet member 110, an upper member 120, and an extension member 130.

The inlet member 110 illustrated in FIG. 2 extends in the same direction as a direction in which the fluid, that is, a coolant, is introduced and travels. The inlet member 110 may be formed in a pipe shape to allow the coolant to pass therethrough. A support member 140 is formed above the inlet member 110 to allow the upper impeller member 100 to be supported by a support shaft 300 described later. The support member 140 is included in the upper impeller member 100 and may rotate together with the impeller when the impeller rotates.

As illustrated in FIG. 3, the upper member 120 is connected to a lower end of the inlet member 110 and extends in a downward direction, and an inner diameter of the upper member 120 increases in the downward direction. That is, the upper member 120 may be formed in a funnel shape.

As illustrated in FIG. 3, the extension member 130 is connected to a lower end (that is also an outer end) of the upper member 120 and outwardly extends (a horizontal direction of FIG. 3). A length L1 of the extension member 130 illustrated in FIG. 3 is determined depending on a height L2 of a discharge space 15 in which the extension member 130 is positioned.

More specifically, when the height of the discharge space 15 in which the extension member 130 is positioned is 100, the length of the extension member 130 may be 40 to 70. Limitation of the length of the extension member 130 in the exemplary embodiment is to secure a space required until the fluid is stabilized, the fluid being moved to the discharge space 15 formed by the extension member 130 in the discharge space 15 positioned between an upper surface of the lower impeller member 200 and a lower surface of the upper member 120. The fluid may be more stably discharged from the discharge space 15 to a discharge path 14 as the length of the extension member 130 increases; however, the length of the extension member 130 may be limited to 40 to 70% of the height of the discharge space 15 due to a design or other reasons, and an actual length of the extension member 130 may be at least 2 mm.

The length L1 of the extension member 130 may extend based on an inner surface of the discharge space 15 which is a space between the upper impeller member 100 and the lower impeller member 200, instead of an outer surface of the upper impeller member 100.

As illustrated in FIGS. 2 and 3, the discharge space 15 is a space which is formed by coupling the upper impeller member 100 and the low impeller member 200 to each other and in which the fluid is introduced, moved, and discharged.

In FIG. 3, a portion at which the upper member 120 and the extension member 130 are connected to each other is a portion at which a straight line extending from the upper member 120 and a straight line extending from the extension member 130 are connected to each other with an angle. However, the present invention is not limited thereto, and it is possible to implement an exemplary embodiment in which a portion formed by connecting the upper member 120 and the extension member 130 is formed in a curved surface. In the case where the portion formed by connecting the upper member 120 and the extension member 130 is formed in a curved surface, a flow restriction of the fluid discharged outwardly of the impeller is further reduced, such that an occurrence of turbulence may be prevented.

As illustrated in FIGS. 2 and 3, the lower impeller member 200 is coupled to a lower portion of the upper impeller member 100, although not illustrated, may include a plurality of blades extending upwardly of the upper surface of the lower impeller member 200, rotating, and pushing the coolant to the discharge path 14 positioned on an outer side of the impeller.

An edge portion of the lower impeller member 200, that is, a portion of the lower impeller member 200 which is positioned side by side with the extension member 130, is formed in parallel with the extension member 130, such that the discharge space between the lower impeller member 200 and the extension member 130 is constantly maintained, thereby minimizing a cavitation and a flow restriction of the coolant discharged to the discharge space.

Figure 4:
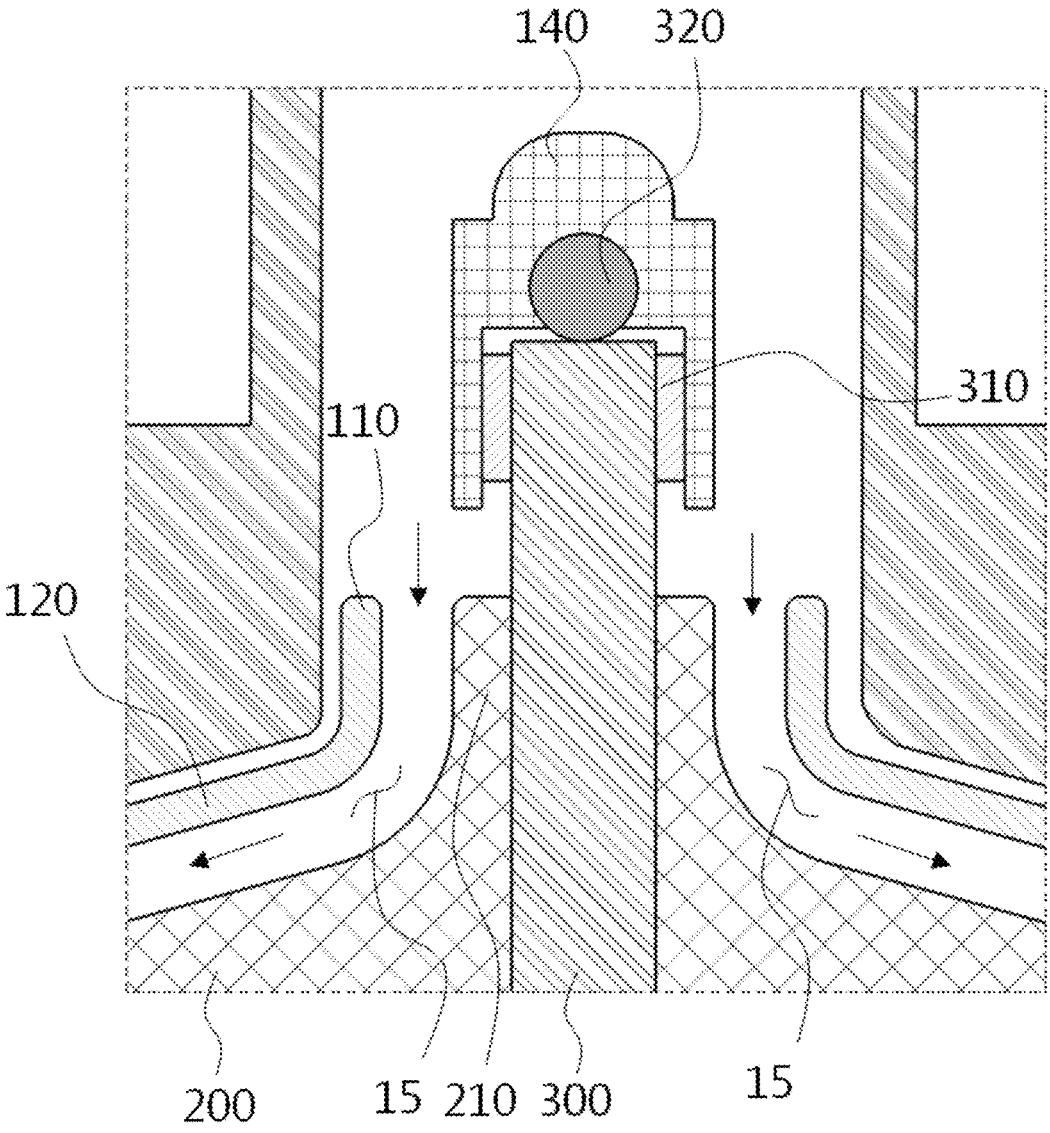
FIG. 4 is another partially enlarged view of FIG. 2.

FIG. 4 is an enlarged view illustrating a fourth region S4 of FIG. 2.

As illustrated in FIG. 4, a portion at which the inlet member 110 and the upper member 120 are connected to each other is also formed in a curved surface, in order to minimize the flow restriction at the portion at which the inlet member 110 and the upper member 120 are connected to each other.

As illustrated in FIG. 4, the support shaft 300 is inserted into the central portion of the lower impeller member 200 to allow the impeller according to the present invention to rotate by supporting the impeller.

As illustrated in FIG. 4, the support member 140 is positioned above the support shaft 300 and a ball 320 is formed between an upper end of the support shaft 300 and the support member 140 to minimize a frictional force between the support member 140 which rotates and the support shaft 300. A bearing 310 is formed on an upper side surface of the support shaft 300 to prevent a rotational force of the impeller from not being transferred to the support shaft 300.

Since a portion of the lower impeller member 200 according to the related art into which the support shaft 300 is inserted is also in contact with the support shaft 300 and an angle is thus formed at the corresponding portion, a flow restriction of the coolant occurs at the corresponding portion, which may be a cause of reducing pumping efficiency of the impeller for an electric water pump according to the present invention.

In order to solve the problems described above, in the impeller for an electric water pump according to an exemplary embodiment of the present invention, as illustrated in FIG. 4, the lower impeller member 200 may include a protruding portion 210 protruding upwardly from the upper surface thereof, that is, along a direction of the discharge space and partially surrounding an outer surface of the support shaft 300.

As illustrated in FIG. 4, an outer surface of the protruding portion 210 may be partially formed in a curved surface to allow the fluid to smoothly flow in the vicinity of the protruding portion 210.

As illustrated in FIGS. 2 to 4, a width of the discharge space 15 formed by inner surfaces of the upper impeller member 100 and the lower impeller member 200 may be constantly maintained from when the fluid is introduced from an inlet of the discharge space 15 to when the fluid is discharged. The reason that the width of the discharge space 15 is constantly maintained from the inlet to an outlet is to stabilize the flow of the fluid introduced into the discharge space 15, to constantly maintain a pressure generated by the fluid, and thus to prevent the upper and lower impeller members from being damaged.

For the configuration as described above, the inner surface of the lower impeller member 200 (upper surface of FIG. 4) may be obliquely formed along an upward direction of the support shaft 300.

The impeller for an electric water pump according to the present invention as described above may improve pumping efficiency. In a case where the impeller for an electric water pump according to the present invention is applied to an electric vehicle in which all devices are operated by electricity, it is possible to pump a constant amount of coolant with lower power than the related art, resulting in further improvement of power usage efficiency in the electric vehicle.

As set forth above, according to the impeller for an electric water pump according to the present invention, the extension member outwardly extends from the one end of the upper member, such that it is possible to prevent the cavitation of the fluid at the corresponding portion, thereby preventing the impeller or the blades formed in the impeller from being damaged.

Further, the portion at which the upper member and the extension member are connected to each other is formed in the curved surface, such that the flow restriction of the fluid in the impeller is reduced, thereby improving the pumping efficiency of the impeller.

Further, according to the present invention, the portion at which the inlet member and the upper member are connected to each other is formed in the curved surface, such that the flow restriction at the corresponding portion is reduced, thereby improving the pumping efficiency of the impeller.

Further, according to the present invention, the protruding portion whose outer surface is formed in the curved surface partially surrounds the support shaft inserted into the central portion of the lower impeller member, such that the flow restriction at the corresponding portion is reduced, thereby improving the pumping efficiency of the impeller.

Further, according to the present invention, the width of the discharge space of the fluid is constantly maintained, such that the flow of the fluid may be constantly maintained, thereby improving the pumping efficiency of the impeller and preventing the impeller from being damaged.

The present invention is not limited to the above-mentioned exemplary embodiments but may be variously applied, and may be variously modified by those skilled in the art to which the present invention pertains without departing from the gist of the present invention claimed in the claims.

What is claimed is:

1. An impeller for an electric water pump, comprising:

an inlet member formed in a pipe shape extending from an upper member to allow a fluid to be introduced through the inlet member and flow through the upper member in a first direction;

the upper member having an inner diameter increasing in size along the first direction;

an extension member outwardly extending from one end of the upper member and at an angle different from that of an inclined angle of the upper member; and a lower impeller member coupled to an upper impeller member formed by the inlet member, the upper member, and the extension member to form a discharge space from which the fluid is discharged from the impeller;

wherein the lower impeller member and the upper impeller member are located inside an upper pump housing and a lower pump housing, which are coupled to each other;

wherein the upper and lower pump housings form a discharge passage to receive and convey the fluid to be discharged from the impeller;

wherein an inlet to the discharge passage is defined between a first portion of the upper pump housing and a second portion of the lower pump housing, wherein the discharge space from the impeller and the inlet to the discharge passage are configured to increase pump efficiency by positioning an end of the extension member defining the discharge space to be identical to a position of the first portion of the upper pump housing defining the inlet to the discharge passage, and by positioning an end of the lower impeller member defining the discharge space to be identical to a position of the second portion of the lower pump housing defining the inlet to the discharge passage, wherein the extension member and the lower impeller member forming the discharge space define a length of the extension member that is in a range of 40 to 70% of a height between the extension member and lower impeller member, wherein an edge portion of the lower impeller member and the extension member are parallel to each other, and wherein inner surfaces of the upper impeller member and the lower impeller member which face each other are parallel to each other to constantly maintain a width of the discharge space.

2. The impeller for the electric water pump of claim 1, wherein a portion at which the upper member and the extension member are connected to each other is formed in a curved surface.

3. An impeller for an electric water pump, comprising:

an inlet member formed in a pipe shape extending from an upper member to allow a fluid to be introduced through the inlet member and flow through the upper member in a first direction;

the upper member having an inner diameter increasing in size along the first direction;

a lower impeller member coupled to an upper impeller member formed by the inlet member and the upper member to form a discharge space from which the fluid is discharged; and the discharge space comprises a height between the lower impeller member and the upper impeller member;

an extension member outwardly extending from one end of the upper member and at an angle different from that of an inclined angle of the upper member;

wherein a portion at which the inlet member and the upper member are connected to each other in a curved surface;

wherein the lower impeller member and the upper impeller member are located inside an upper pump housing and a lower pump housing coupled to each other;

wherein the coupled upper and lower pump housings form a discharge passage to receive and convey the fluid to be discharged from the discharge space; and an inlet to the discharge passage being formed between a first portion included in the upper pump housing and a second portion included in the lower pump housing, wherein, based on the height of the discharge space, a position of an end of the extension member comprising the discharge space is positioned identical to a position of the first portion of the upper pump housing defining the inlet to the discharge passage, and a position of an end of the lower impeller member comprising the discharge space is identical to a position of the second portion of the lower pump housing, wherein a length of the extension member is in a range of 40 to 70% of the height of the discharge space, wherein an edge portion of the lower impeller member and the extension member are parallel to each other, and wherein inner surfaces of the upper impeller member and the lower impeller member that face each other are parallel to each other to constantly maintain a width of the discharge space.

4. An impeller for an electric water pump, comprising:

an inlet member formed in a pipe shape extending from an upper member to allow a fluid to be introduced through the inlet member and flow through the upper member in a first direction;

the upper member having an inner diameter increasing in size along the first direction;

a lower impeller member coupled to an upper impeller member formed by the inlet member and the upper member to form a discharge space from which the fluid is discharged, wherein the lower impeller having a support shaft inserted into a central portion thereof, and having a protruding portion that is partially surrounding the support shaft, and an extension member outwardly extending from one end of the upper member and at an angle different from that of an inclined angle of the upper member;

wherein an outer surface of the protruding portion includes a curved surface; and wherein the lower impeller member and the upper impeller member are located inside an upper pump housing and a lower pump housing coupled to each other, and wherein the upper and lower pump housings form a discharge passage to receive and convey the fluid to be discharged from the impeller;

wherein an inlet to the discharge passage being formed between a first portion in the upper pump housing and a second portion in the lower pump housing, and wherein a position of an end of the extension member defining the discharge space is positioned identical to a position of the first portion of the upper pump housing and a position of an end of the lower impeller member defining the discharge space to be identical to a position of the second portion of the lower pump housing, wherein a length of the extension member is in a range of 40 to 70% of a height between the extension member and the lower impeller member, wherein an edge portion of the lower impeller member and the extension member are parallel to each other, and wherein inner surfaces of the upper impeller member and the lower impeller member that face each other are parallel to each other to constantly maintain a width of the discharge space.

* * * * *